United States Patent [19]

Holt

[11] 4,109,326

[45] Aug. 29, 1978

[54] BATH TUB ENCLOSURE

[76] Inventor: Margaret Holt, c/o George Spector, 3615 Woolworth Bldg., 233 Broadway, New York, N.Y. 10007

[21] Appl. No.: 683,171

[22] Filed: May 4, 1976

[51] Int. Cl.[2] ..... A47K 3/00

[52] U.S. Cl. ..... 4/173 R; 29/455 R; 248/362

[58] Field of Search ..... 4/173, 177, 166, 167, 4/170, 185 R, 12, 173 M; 23/55; 248/206 R, 362, 363; 292/333, 338, DIG. 15; 29/455 R

[56] References Cited

U.S. PATENT DOCUMENTS

| | | | |
|---|---|---|---|
| 193,237 | 7/1962 | Parker | 23/55 |
| 1,140,343 | 5/1915 | Arens | 292/333 |
| 1,518,613 | 12/1924 | Teeter | 292/DIG. 15 |
| 2,801,121 | 7/1957 | Gervais | 292/DIG. 15 |
| 3,487,478 | 1/1970 | Harris | 4/166 |
| 3,736,668 | 6/1973 | Dillarstone | 248/206 R X |
| 3,878,573 | 4/1975 | Boudewyn | 248/206 R X |

FOREIGN PATENT DOCUMENTS

| | | | |
|---|---|---|---|
| 1,390,144 | 1/1965 | France | 4/173 M |
| 1,429,743 | 3/1969 | Fed. Rep. of Germany | 4/173 |
| 2,500,068 | 7/1975 | Fed. Rep. of Germany | 4/173 M |

*Primary Examiner*—Stuart S. Levy

[57] ABSTRACT

An enclosure around the outer side of an old fashioned bath tub so to hide the same from view in order to improve a bathroom decor, the enclosure being a waterproof, plastic, boxlike shell that simply slides down over the top of the tub, and an upper end of the shell covering the upper ledge of the tub when a lower edge of the frame rests upon the floor; the outer side walls of the enclosure being suitable for decorative decals of marine or floral designs being applied thereto.

2 Claims, 6 Drawing Figures

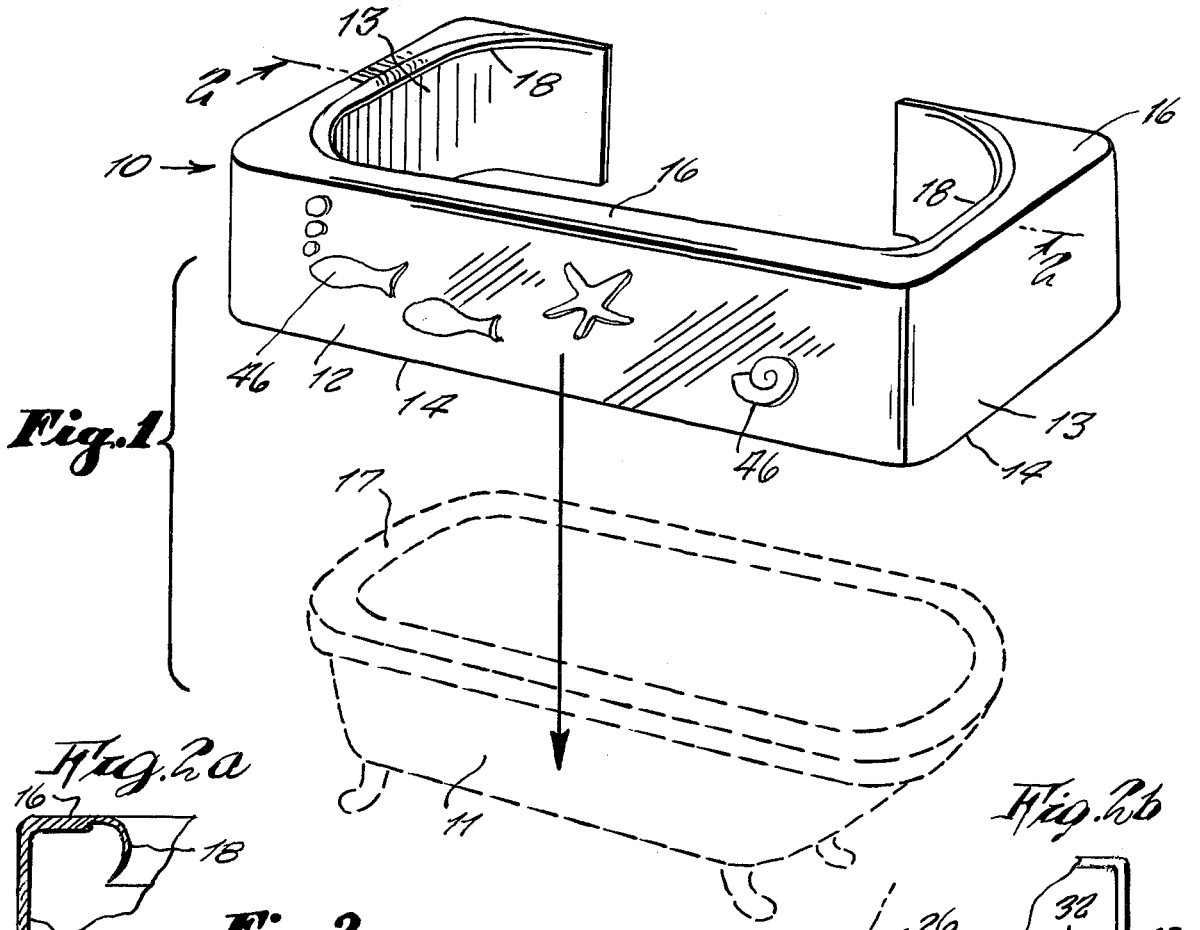
Fig. 1
Fig. 2a
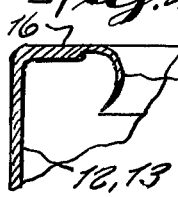
Fig. 2
Fig. 2b
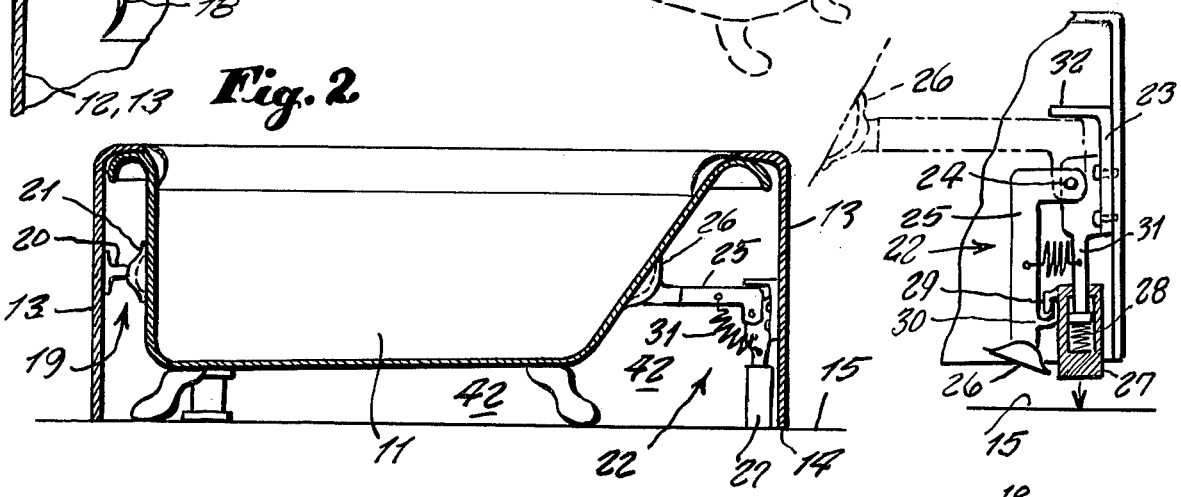
Fig. 3
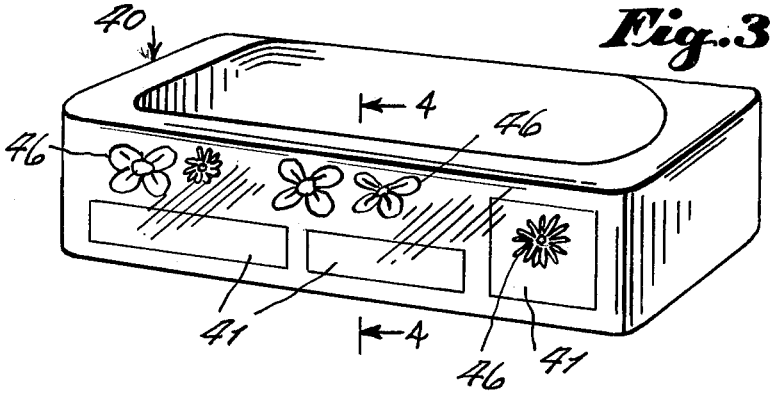
Fig. 4
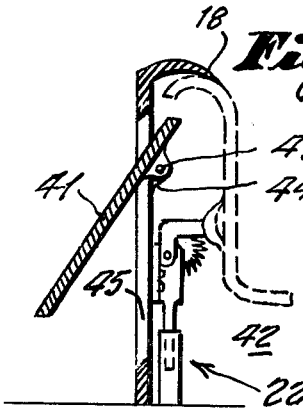

BATH TUB ENCLOSURE

This invention relates generally to home decorative devices. More specifically it relates to bathroom panelling.

It is well known to most homemakers who have an old fashioned bath tub in their bathroom, that it is difficult to make the room more pleasing in appearance and more modern when the legs of the old bathub as well as the bathtube underside end slope is fully in view. This situation is, therefore, objectionable and is, therefore, in want of an improvement.

Accordingly, it is a principal object of the present invention to provide an enclosure for fitting around the old fashioned tub so to hide its underside slope as well as its legs.

Another object is to provide a bath tube enclosure which can be quickly and easily installed by simply sliding it down over the top of the tub, and which requires no special tools or skills to do.

Yet another object is to provide a bathtub enclosure which gives a bathroom a modern look, and wherein the outer side of the enclosure is adaptable for decorative decals of any design being applied thereto.

Yet a further object is to provide a bathtub enclosure which in no way interferes with the normal operation and use of the tub for bathing purposes, and which additionally can be provided with flush doors not readily noticable and which provide access for storage space under the old fashioned tub so to store toilet tissue rolls, cleaning powders, wiping rags and other items which otherwise are objectionable to a view when left exposed.

Other objects are to provide a bath tub enclosure which is simple in design, inexpensive to manufacture, rugged in construction, easy to use and efficient in operation.

These and other objects will be readily evident upon a study of the following specification and the accompanying drawing wherein:

FIG. 1 is a perspective view of the present invention shown in a position ready for being slided downward around an old fashioned bath tub.

FIG. 2 is a cross sectional view taken on line 2—2 of FIG. 1.

FIG. *2a—2a* is an enlarged detail of FIG. 2 and more clearly illustrating a top flap.

FIG. *2b—2b* is an enlarged detail of FIG. 2 and showing more clearly an internal bracing unit.

FIG. 3 is a perspective view of a modified design of an enclosure installed around an old fashioned tub, and showing the same including doors on a front side thereof for access to storage space under the tub.

FIG. 4 is a cross sectional view taken on line 4—4 of FIG. 3 and showing a door in pivoted open position.

Referring now to the drawing in greater detail, and more particularly to FIGS. 1, 2, *2a* and *2b*, thereof at this time, the reference numeral 10 represents an enclosure for an old fashioned tub 11; the enclosure being preferably made of waterproof material such as molded hard plastic so to be precese in size for the particular tub and inexpensive to mass produce. It may be in any color so to suit a bathroom decor. It comprises a box-like sheel of panelling that includes vertical front wall 12, and opposite end walls 13 having a lower edge 14 for resting upon a floor 15. The upper edges of the walls are inwardly turned horizontally so to form a ledge 16 that covers the rounded top ledge 17 of the tub 11. A resilient flap 18 integral with the inner edge of ledge 16 extends downwardly into the tub and bears against the tub surface so to form a tight fit therewith.

Affixed on the inner side of the shell, there are several bracing units which firmly hold the walls of the shell braced relative to the tub. Some of such bracing units 19 simply comprise a rigid sidward arm 20 affixed to the shell wall and having a rubber suction cup 21 on an end for bearing against the tube. Other bracing units 22 on opposite sides to units 19, are automatically operated to swing from an inoperative position to an operative position when the unit engages a floor. Units 22 each includes a stationary bracket 23 supporting pivot pin 24 about which an arm 25, having suction cup 26, is pivotable. A sleeve 27 slides on a lower end of the bracket against a compression spring 28, so that when a lower end of the sleeve abutts against a floor 15 as indicated in FIG. *2b*, a hook 29 on the sleeve disengages with a hook 30 on the arm thus freeing the arm to pivot upwardly into a horizontal position due to a compression coil spring 31 between the bracket and the arm. Thus the suction cup 26 snaps to rest against the tub. A stop 32 limits the arm upward swing.

In FIGS. 3 and 4, another design of enclosure 40 is the same as enclosure 10 except that it additionally includes doors 41 on its exposed walls, the doors being close fitted and flush so to be not readily visible and thus not spoiling the illusion of being a conventional ceramic tub. The doors provide access to spaces 42 underneath and at a rear of the tub so that various objects can be stored hidden therewithin. The doors are pivotable about a horizontal pivot pin 43 supported in lugs 44 integral with the inner side of the walls. Upper and lower edges of the door are angled so to rest snuggly tight against corresponding upper and lower edges of the door opening 45, so that the seam therebetween is minimal in order to be invisible.

Thus a bathtub enclosure is provided for modernizing an old fashioned bath tub.

As shown decorative decals 46 of floral, marine or other subject can be applied to the front side of the enclosure.

While various changes may be made in the detail construction, it is understood that such changes will be within the spirit and scope of the present invention as is defined by the appended claims.

What is claimed is:

1. An enclosure adapted to be mounted over a bath tub on a support surface, said enclosure comprising a shell of box-like shape including integral vertical front and opposite side walls integrally joined with a horizontal ledge for enclosing above the upper rim of said bathtub, said ledge having a resilient inner flap along the inner edge thereof, said flap being adapted to bear against the inner side of said bathtub to form a tight seal therebetween, a movable brace mounted on an inner side of said shell and means secured to said shell retaining said brace in an operative position when said shell is not mounted over the tub, and operative to release said brace for movement to a position against a side of the tub when said shell is mounted over said tub, wherein said means comprises a bracket mounted on an inner side of the shell and having a leg extending downwardly with a sleeve mounted slidably thereon, said brace being pivotally mounted on said bracket, coacting hooks mounted on said sleeve and brace serving to retain said brace in said inoperative position, a compression coil spring mounted between said leg and brace, and a spring mounted in said sleeve engaging said leg to bias said sleeve downwardly towards said support surface whereby engagement of said sleeve with said support surface causes an upward sleeve movement to disengage said hooks and release said brace to a position against the side of the tub.

2. An enclosure as in claim 1 including access doors pivotally mounted in said shell fitting flush with the shell surface and adjacent said means and brace.

* * * * *